United States Patent [19]

Becker

[11] 4,448,146

[45] May 15, 1984

[54] RUDDER WITH A STABILIZER FIN

[75] Inventor: Willi Becker, Hamburg, Fed. Rep. of Germany

[73] Assignee: Willi Becker Ingenieurbüro GmbH, Hamburg, Fed. Rep. of Germany

[21] Appl. No.: 349,082

[22] PCT Filed: Oct. 29, 1981

[86] PCT No.: PCT/DE81/00182

§ 371 Date: Feb. 11, 1982

§ 102(e) Date: Feb. 11, 1982

[87] PCT Pub. No.: WO82/01527

PCT Pub. Date: May 13, 1982

[30] Foreign Application Priority Data

Oct. 30, 1980 [DE] Fed. Rep. of Germany ..... 3040808

[51] Int. Cl.[3] ..... B63H 25/06

[52] U.S. Cl. ..... 114/162; 114/167

[58] Field of Search ..... 114/162, 163, 165, 167; 244/87, 215; 308/DIG. 8

[56] References Cited

U.S. PATENT DOCUMENTS 3,856,423 12/1974 Uchida ..... 308/DIG. 8

FOREIGN PATENT DOCUMENTS 49533 5/1940 Netherlands ..... 114/167

*Primary Examiner*—Sherman D. Basinger

*Attorney, Agent, or Firm*—Toren, McGeady and Stanger

[57] ABSTRACT

A high-performance main rudder with a stabilizer fin (10) articulated to the rudder plate (20) for ocean-going ships is provided with a fork-like sliding bearing (30) for a swivel piston (40) or drive rod held and guided by interchangeable slide or guide blocks (60) mounted in the fork arms (31,32) of the sliding bearing (30) which is pivoted on a hinging bolt (50) fixed to the hull.

11 Claims, 9 Drawing Figures

RUDDER WITH A STABILIZER FIN

SUMMARY OF THE INVENTION

The invention relates to a rudder, particularly a BECKER high-performance rudder, with a stabilizer articulated to the rudder plate for ocean-going vessels.

The most varied solutions have already been proposed for the articulation of the stabilizer in the case of stabilizer rudders for ocean-going vessels. It is common to all the known solutions that the particularly wear-prone parts of the articulation for the forced guidance of the stabilizer can only be replaced as a result of the considerable expenditure and mainly by working underwater.

The problem of the present invention is to provide a sliding swivel piston articulation for the stabilizer of a rudder, particularly a BECKER high-performance rudder with a forcibly guided stabilizer, permitting the forced guidance of the stabilizer as a function of the angular position of the main rudder plate with an exclusively horizontal transfer of forces and which permits an effortless replacement of worn parts by untrained personnel without using lifting tackle and without carrying out work underwater.

According to the invention this problem is solved by a rudder of the aforementioned type constructed in such a way that the stabilizer has a fork-like sliding bearing for a swivel piston made from a material which is resistant to salt water, such as high-grade steel, which is held and guided by means of interchangeable guide or slide blocks of plastics materials, particularly polyamide, between the fork or pivot arms of the sliding bearing and which is pivoted on a hinging bolt fixed to the hull.

Stabilizer actuation in all rudder positions is possible with a sliding swivel piston articulation constructed in this way with a forcibly guided rudder, particularly a high-performance rudder. Worn parts, in this case the guide blocks and which are more particularly made from polyamide, can be replaced without difficulty by untrained personnel, without it being necessary to work underwater. In addition, a full-area engagement of the swivel piston on the fork or pivot arms of the sliding bearing, accompanied by the interposing of interchangeable guide blocks is ensured.

Further advantageous developments of the invention can be gathered from the subclaims. The construction according to FIG. 6 is particularly advantageous and in this case each guide block which is pivotable about its vertical axis is held in its recess in the fork or pivot arms, so that there is an automatic setting and alignment of the guide blocks with respect to the swivel piston position and simultaneously tilting of the swivel piston is prevented. In an advantageous embodiment the hinging bolt for the swivel piston carries a bronze sleeve and at its free end there is a limiting disk on which is provided a bush made from plastics material, particularly polyamide for supporting the swivel piston. This construction of the hinging bolt in conjunction with the mounting of the swivel piston on the latter makes it possible to bring about a height compensation in the vicinity of the fulcrum, whilst the guide blocks and an additional slide block made from plastics materials, particularly polyamide, arranged on the base plate between the fork or pivot arms of the sliding bearing assist in preventing any tilting of the swivel piston. The guide blocks used absorb forces directed in the same or opposite directions.

BRIEF DESCRIPTION OF THE DRAWING

The invention is described in greater detail hereinafter relative to the non-limitative embodiments and the attached drawings, wherein show.

DETAILED DESCRIPTION OF THE INVENTION

Figure 1:
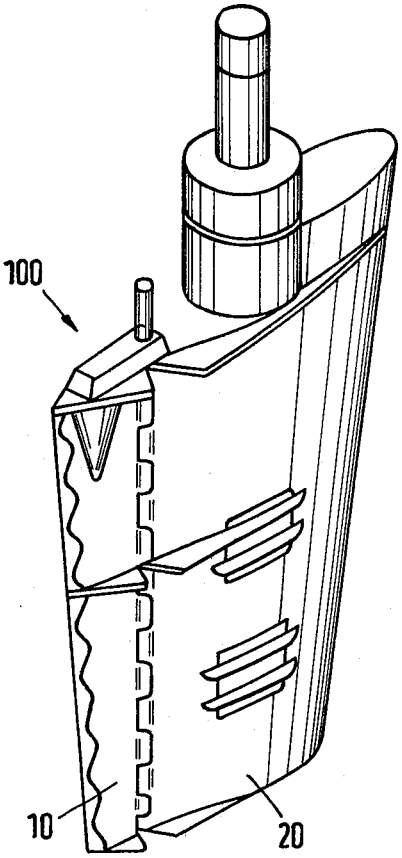
FIG. 1: a high-performance rudder with a stabilizer and the sliding swivel piston articulation in a diagrammatic view.

The rudder shown in FIG. 1 and in particular a BECKER high-performance rudder, comprises a rudder plate 20 with a stabilizer fin 10 pivotably mounted and forcibly guided thereon, which is provided with a swivel piston or drive articulation 100.

This sliding swivel piston or drive articulation 100 comprises a sliding bearing 30 constructed on stabilizer 10 for a swivel piston or drive rod 40, which is made from a material which is resistant to salt water, such as high-grade steel and whose projecting end **40*a* is pivoted on a hinging bolt 50** fixed to the hull.

Figure 2:
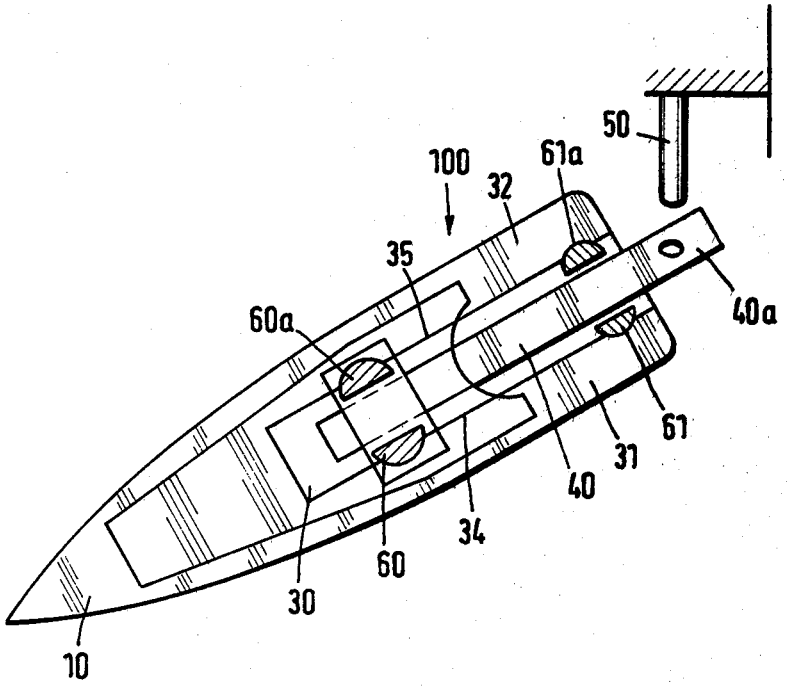
FIG. 2: the stabilizer with the sliding bearing for the swivel piston in a diagrammatic view from above.
Figure 3:
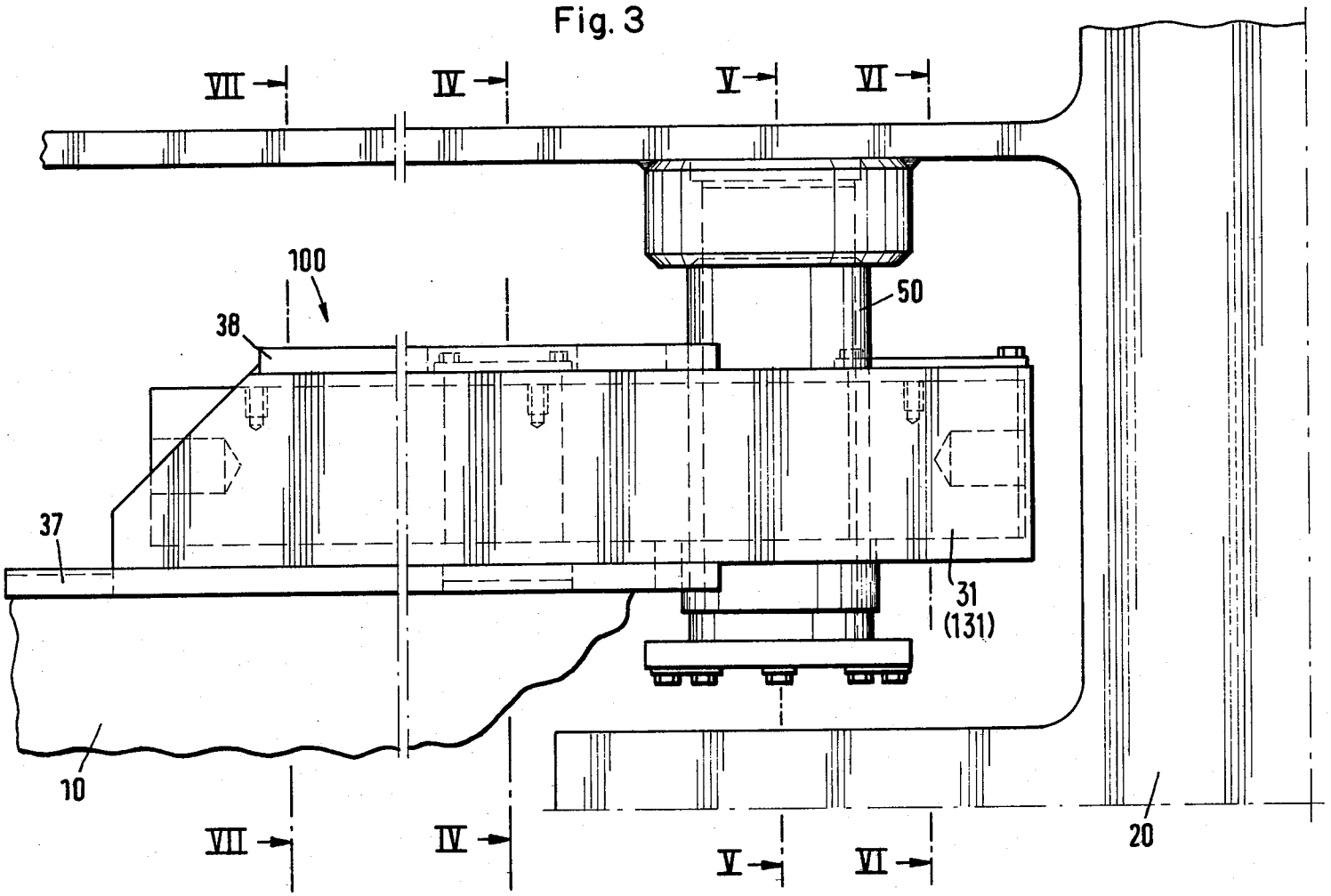
FIG. 3: the sliding bearing with the swivel piston in a side view.

The fork-like sliding bearing 30 for swivel piston 40 has two fork or pivot arms 31, 32, or 131, 132 between which is slidably held and guided swivel piston 40 by means of slide or guide blocks **60, 60*a* and 61, 61*a*. The fork-like sliding bearing 30 is constructed in such a way on the stabilizer that the opening 33 formed by the two fork or pivot arms 31, 32 or 131, 132** faces the rudder plate (FIGS. 2 and 3).

The guide blocks **60, 60*a* and 61, 61*a* are arranged in such a way on the facing inner wall surfaces 34 and 35 of the fork or pivot arms 31, 32 or 131, 132** that they are easily interchangeable.

Figure 4:
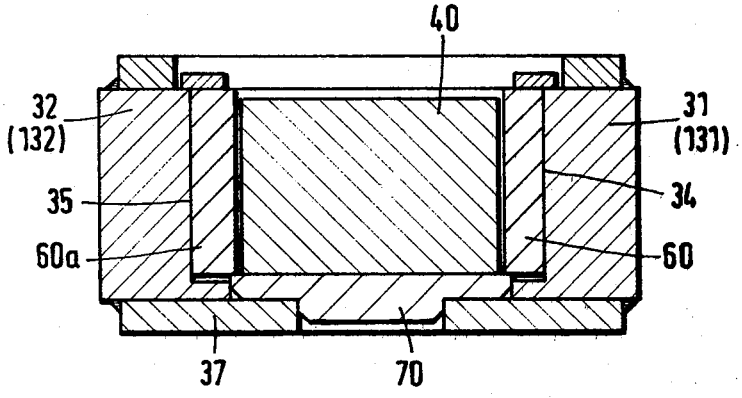
FIG. 4: a vertical section along line IV—IV of FIG. 3.
Figure 6:
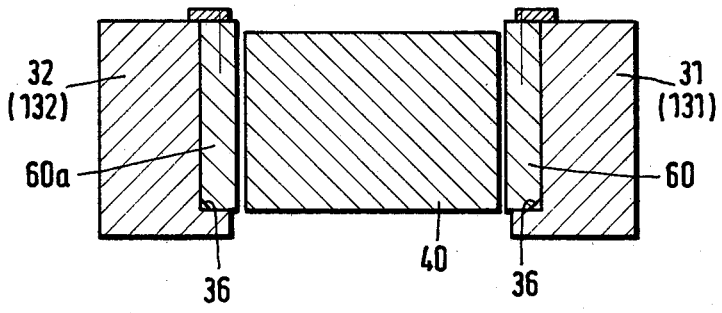
FIG. 6: a vertical section along line VI—VI of FIG. 3.
Figure 7:
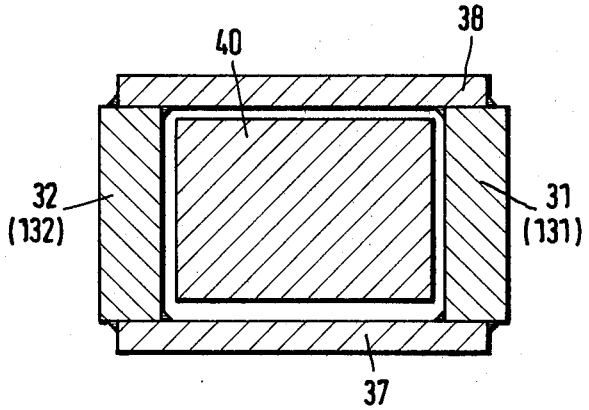
FIG. 7: a vertical section along line VII—VII of FIG. 3.

For this purpose the guide blocks **60, 60*a* and 61, 61*a* are held in recesses 36 formed in the wall surfaces 34, 35 of fork or pivot arms 31, 32, or 131, 132** (FIGS. 4 and 6).

The number of guide blocks **60, 60*a* and 61, 61*a* for the sliding mounting of swivel piston 40 can be chosen at random. However, it is important that the guide blocks are combined in pairs and are arranged so as to face one another on the inner wall surfaces 34, 35 of the fork or pivot arms 31, 32 or 131, 132 of sliding bearing 30. In the case of the embodiment shown in the drawing, two pairs of guide blocks 60, 60*a* and 61, 61*a*** are provided (FIGS. 3 and 4). However, it is also possible to use a larger number of guide block pairs. The minimum number is one pair of guide blocks.

Figure 8:
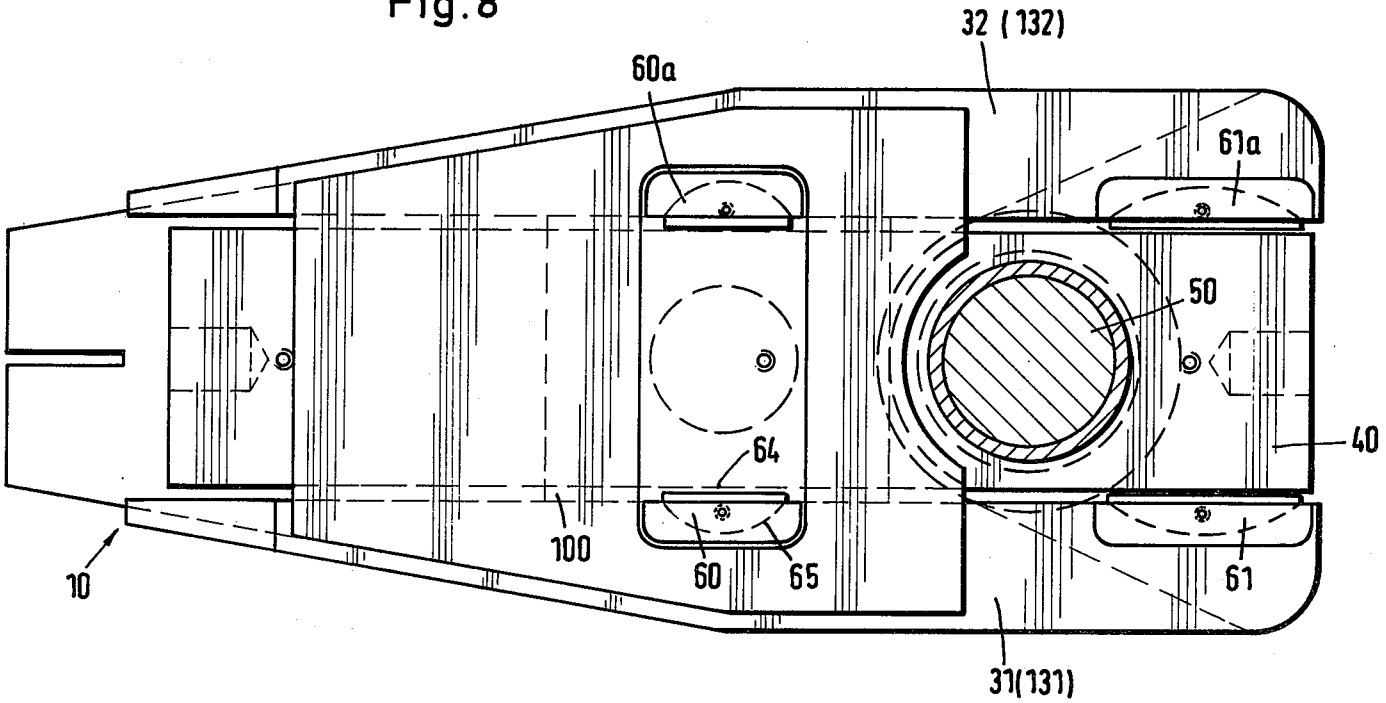
FIG. 8: the sliding swivel piston articulation in a view from above.
Figure 9:
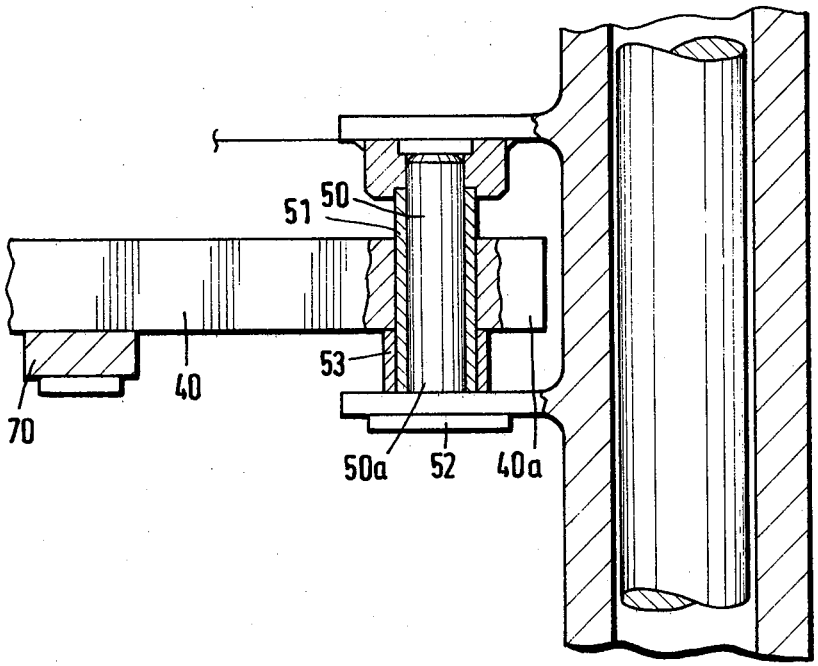
FIG. 9: the articulation of the swivel piston on its hinging bolt, partly in elevation and partly in cross-section.

Each guide block **60, 60*a* or 61, 61*a* comprises a profile member with an approximately semicircular cross-section, whose arc-like outer surface is indicated at 65 and whose planar outer surface is indicated at 64 and forms the engagement surface for swivel piston 40, which has a square or rectangular cross-section. Like swivel piston 40, the two fork or pivot arms 31, 32 or 131, 132 are made from a material which is resistant to salt water, such as high-grade steel (FIG. 8**).

Each guide block 60, 60*a* and 61, 61*a* is pivotally held in a correspondingly constructed recess 36 in wall surface 34 or 35 of the fork-or pivot arms 31, 32 or 131, 132 and advantageously this is about its vertical axis 65, so that all the guide blocks 60, 60*a* and 61, 61*a* can match the movements of swivel piston 40, so that there is always a frictional connection between swivel piston 40 and the fork or pivot arms 31, 32 or 131, 132 of sliding bearing 30 and consequently with stabilizer 10.

Recesses 36 are closed at the bottom and open at the top, so that guide blocks 60, 60*a* and 61, 61*a* can be inserted from above into the recesses 36 associated therewith. It is possible to provide guide profiles on guide blocks 60, 60*a* and 61, 61*a*, as well as on the walls bounding recess 36 if the blocks are not pivotable about their vertical axes 65.

As shown in FIG. 3 sliding bearing 30 comprises a base plate 37 arranged on stabilizer 10 or which itself forms the upper stabilizer cover. Pivot arms 131, 132 are arranged in spaced manner on base plate 37 so as to form the fork arms 31, 32. These arms on the facing inner wall surfaces 34, 35 carry guide blocks 60, 60*a* and 61, 61*a*, as well as the recesses or bearings 36 associated with the blocks. Swivel piston 40 is slidably guided between the guide blocks 60, 60*a* and 61, 61*a*. An upper cover plate 38 interconnects the two pivot arms 131, 132 and simultaneously closes the upper openings of recesses 36, so that on replacing worn guide blocks 60, 60*a*, 61, 61*a* it is merely necessary to remove cover plate 38, so that the upper openings of recesses 36 are free for the removal of the blocks. Cover plate 38 is preferably detachably connected by means of screw couplings to pivot arms 131, 132 (FIGS. 3 and 4). The length of the fork or pivot arms 31, 32, or 131, 132 corresponds approximately to the length of swivel piston 40. Upper cover plate 38 is then provided with a recess for the passage of hinging bolt 50.

Figure 5:
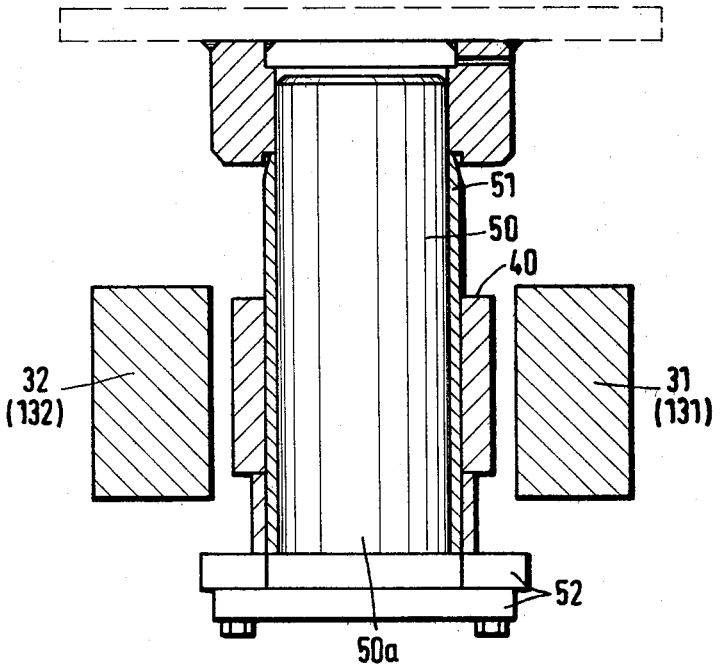
FIG. 5: a vertical section along line V—V of FIG. 3.

The free end 40*a* of swivel piston 40 is pivotably mounted on hinging bolt 50. According to the embodiment of FIG. 5 said hinging bolt 50 carries a salt water-resistant bronze sleeve 51 and has a limiting disk 52 on its free end 50*a*. Limiting disk 52 carries a bush 53 made from plastics materials, particularly polyamide, which surrounds the hinging bolt 50 and on which is supported the swivel piston 40. For the purpose of supporting swivel piston 40 it is also possible to provide a slide block 70 made from plastics materials, particularly polyamide, on base plate 37 between the fork or pivot arms 31, 32 or 131, 132 and this simultaneously serves as a bearing support for swivel piston 40 (FIG. 4).

Instead of forming the guide block pairs 60, 60*a* and 61, 61*a* from individual guide blocks, it is also possible to provide on the inner wall surfaces 34, 35 of the two fork and pivot arms 31, 32 or 131, 132 guide blocks which extend over the entire length of these arms and which are then held in correspondingly constructed recesses in wall surfaces 34, 35.

I claim:

1. A rudder for ocean going ships comprising an upwardly extending main rudder (20), an upwardly extending stabilizer fin (10) hinged to said main rudder and forcibly guided by said main rudder, a swivel drive articulation (100) connected to the upper end of said stabilizer fin (10), said drive articulation (100) comprises a slide bearing (30) located at the upper end of said fin and extending transversely of the upward direction, an elongated drive rod (40) positioned in said slide bearing with one end of said drive rod located within said slide bearing and the other end thereof extending out of said slide bearing, hinging bolt (50) arranged to be fixed to a ships's hull and extending in the upward direction, the end of said drive rod (40) extending out of said slide bearing is pivotally mounted on said hinging bolt, said slide bearing (30) has a forked configuration and includes a pair of fork arms (31, 32) disposed in laterally spaced relation with said drive rod (40) located therebetween and said fork arms extend transversely of the upward direction, each of said fork arms has a wall surface (34,35) facing the other said wall surface with said drive rod (40) located between said wall surfaces, at least one recess (36) formed in each of said wall surfaces (35,36) open toward said drive rod (40), said recess (36) being open in the upward direction, a replaceable guide block (60,60*a*,61,61*a*) formed of plastic and inserted in said open recess so that said guide block projects inwardly from said wall surface toward said drive rod, and means located at the upper end of said recesses (36) for blocking unintentional removal of said guide blocks from said recesses.

2. A rudder, as set forth in claim 1, wherein said guide blocks are formed of polyamide.

3. A rudder, as set forth in claim 1, wherein said means for blocking the upper end of said recesses (36) comprises a detachable cover plate (38).

4. A rudder, as set forth in claim 3, wherein said slide bearing comprises a base plate (37) spaced downwardly from said cover plate (38), said base plate forms the upper covering of said stabilizer fin (10), said fork arms extend upwardly from said base plate with said drive rod (40) bounded by said fork arms, said cover plate and said base plate, and said cover plate is detachably secured to said fork arms.

5. A rudder, as set forth in claim 4, wherein at least one guide block (70) formed of a plastics material is located between said base plate (37) and the underside of said drive rod (40).

6. A rudder, as set forth in claim 5, wherein said guide block (70) is formed of polyamide.

7. A rudder, as set forth in claim 1, wherein said guide blocks (60, 60*a*, 61, 61*a*) are arranged opposed one another on opposite sides of said drive rod (40).

8. A rudder, as set forth in claim 1, wherein each said recess (36) has an arc-shaped surface in said fork arm (31,32), each said guide block has an approximately semi-circular cross-section transverse to the upward direction and the surface of said guide blocks correspond to the arc-shaped surface of said recesses, each said guide block has a planar surface (64) spaced outwardly from said recess (36) and disposed in sliding contact with the adjacent surface of said drive rod (40).

9. A rudder, as set forth in claim 8, wherin said drive rod (40) has a rectangularly shaped cross-section.

10. A rudder, as set forth in claim 8, wherein each said guide block (60, 60*a*, 61, 61*a*) is held in said recesses (36) in said fork arms (31,32) so as to be pivotal about the upwardly extending axis of said guide block.

11. A rudder, as set forth in claim 1, wherein said hinging bolt (50) has an upper end and a lower end, a bronze sleeve (51) laterally enclosing said hinging bolt (50) from the lower end thereof toward the upper end, a limiting disk (52) extending transversely of said hinging bolt and located at the lower end thereof, and a bushing (53) laterally enclosing the lower end of said bronze sleeve (51) and extending upwardly to the underside of said drive rod (40).

* * * * *